US005692483A

United States Patent [19]

Wada et al.

[11] Patent Number: 5,692,483

[45] Date of Patent: Dec. 2, 1997

[54] IGNITION COIL USED FOR AN INTERNAL COMBUSTION ENGINE

[75] Inventors: Junichi Wada, Aichi-ken; Akiyoshi Yamamoto; Masahiro Inagaki, both of Chiryu, all of Japan

[73] Assignee: Nippondenso Co., Ltd., Kariya, Japan

[21] Appl. No.: 673,106

[22] Filed: Jul. 1, 1996

[30] Foreign Application Priority Data

Jun. 30, 1995 [JP] Japan ..... 7-166201
Jul. 19, 1995 [JP] Japan ..... 7-182635

[51] Int. Cl.[6] ..... F02P 11/00

[52] U.S. Cl. ..... 123/634

[58] Field of Search ..... 123/634, 647, 123/633, 635

[56] References Cited

U.S. PATENT DOCUMENTS

| | | | |
|---|---|---|---|
| 3,209,295 | 9/1965 | Baermann | 123/634 |
| 4,120,277 | 10/1978 | Ehlan | 123/634 |
| 4,446,842 | 5/1984 | Iwasaki | 123/634 |
| 4,509,495 | 4/1985 | Betz et al. | 123/634 |
| 4,546,753 | 10/1985 | Pierret | 123/634 |
| 4,658,799 | 4/1987 | Kusaka et al. | 123/634 |
| 5,003,959 | 4/1991 | Umezaki et al. | 123/647 |
| 5,036,827 | 8/1991 | Shimada et al. | 123/634 |

FOREIGN PATENT DOCUMENTS

| | | | |
|---|---|---|---|
| 48-31453 | 4/1973 | Japan | 123/634 |
| 61-157420 | 7/1986 | Japan | 123/634 |
| 63-80833 | 5/1988 | Japan | 123/634 |
| 2-106910 | 4/1990 | Japan | 123/634 |
| 2-156513 | 6/1990 | Japan | 123/634 |
| 3-22326 | 1/1991 | Japan | 123/634 |
| 6-6498 | 2/1994 | Japan | 123/634 |
| 7-29747 | 1/1995 | Japan | 123/634 |

OTHER PUBLICATIONS

"Automatic bobbinless coil winding machine No. 3000NC, NC–II; TAGA".

*Primary Examiner*—Raymond A. Nelli

*Attorney, Agent, or Firm*—Cushman, Darby & Cushman IP Group of Pillsbury, Madison & Sutro, LLP

[57] ABSTRACT

Two separate iron cores 31 and 32, forming a magnetic path, are engaged with both ends of a cylindrical coil body 12. Each iron core has upper and lower limbs disposed in parallel with each other. Cylindrical coil body 12 accommodates a primary coil 221 and a secondary coil 223 therein, and has a core-insertion hole 4 for receiving the iron cores 31 and 32. The upper limb of each iron core is inserted in core-insertion hole 4 while lower limb extends along an outer wall of cylindrical coil body 12, so that cylindrical coil body 12 is engaged with iron cores 31 and 32 by these upper and lower limbs clamping between an inside wall of core-insertion hole 4 and the outer wall of cylindrical coil body 12. Primary coil 221 has an outermost layer formed into a dense alignment winding layer at its end part and into a non-dense alignment winding layer at its middle part. A connector la is integrally formed with a coil casing 1 of coil body 12, so as to extend in a direction perpendicular to an insertion direction of an ignitor 211 and closely to an opening portion of an ignitor housing 213 formed in coil casing 1.

19 Claims, 15 Drawing Sheets

IGNITION COIL USED FOR AN INTERNAL COMBUSTION ENGINE

BACKGROUND OF THE INVENTION

1. Field of the Invention

This invention relates to an ignition coil preferably used for an internal combustion engine, and more particularly to an ignition coil compact in size and highly flexible in the installation to an internal combustion engine, and durable against external forces such as vibrations.

2. Related Art

An ignition coil for an internal combustion engine is generally associated with iron cores and installed in the vicinity of the engine body disposed in a narrow and crowded engine room of an automotive vehicle. Hence, the ignition coil is subjected to vibrational forces acting from the outside due to engine operation and travelling of the automotive vehicle. Hence, there is a possibility that iron cores may be loosened or disengaged from the coil body.

To prevent this kind of looseness and disengagement, there is known a technology disclosed in Japanese Utility Model No. HEI 6-6498, published in 1994, according to which a saw-toothed portion is provided on the iron core to bite the inside wall of a core-insertion hole formed in the coil body.

Unexamined Japanese Utility Model Application No. SHO 63-80833, published in 1988, also discloses a technology of preventing this kind of looseness and disengagement, according to which the iron core is formed with a concave portion engageable with a convex portion formed on the inside wall of the core-insertion hole of the coil body.

However, according to these conventional technologies, there is a necessity of forming a complex configuration on the iron core and, hence, there is a possibility that the production efficiency is worsened. Furthermore, providing a recessed portion on the iron core as disclosed in the latter case will increase the magnetic resistance of the iron core.

Still further, downsizing the ignition coil is a recent trend to increase the degree of freedom in determining the layout of the ignition toil to facilitate its installation in the vicinity of an internal combustion engine in a narrow and crowded engine room.

However, as disclosed in Unexamined Japanese Patent Application No. HEI 7-29747, published in 1995, the installation (insertion) direction of an ignitor and the ignition coil is identical with the projecting direction of connector pins electrically connected with the ignitor. Hence, a connector is necessarily disposed in parallel with a coil casing, resulting in an undesirable extension of a conductive path between circuit terminals provided at an opening side of the coil casing and the connector pins. Accordingly, the downsizing of the ignition coil cannot be realized sufficiently due to the presence of a large space necessarily provided around this elongated conductive path.

SUMMARY OF THE INVENTION

Accordingly, in view of above-described problems encountered in the related art, a principal object of the present invention is to provide a novel and excellent ignition coil durable against vibrational external forces and compact in size. Another object of the present invention is to provide an ignition coil which is easy to manufacture.

In order to accomplish this and other related objects, an aspect of the present invention provides an ignition coil for an internal combustion engine, according to which there is provided at least one iron core for forming a magnetic path. This iron core has first and second portions disposed in parallel with each other. A cylindrical coil body accommodates a primary coil and a secondary coil therein. The cylindrical coil body has a core-insertion hole for receiving the iron core. The first portion is inserted in the core-insertion hole while the second portion extends along an outer wall of the cylindrical coil body, so that the cylindrical coil body is engaged with the iron core by the first and second portions clamping between an inside wall of the core-insertion hole and the outer wall of the cylindrical coil body.

According to features of preferred embodiments of a first aspect of the present invention, two iron cores are provided at both axial ends of the cylindrical coil body, so that the magnetic path is formed by these two iron cores clamping the axial ends of the cylindrical coil body. Furthermore, a deformable portion is integrally formed on the outer wall of the coil body, so that the iron core is engaged with the coil body through this deformable portion. Still further, a slant guide surface is provided adjacently to and continuously from the second portion of the iron core so that a clearance between the iron core and the outer wall of the coil body is enlarged at a portion corresponding to the slant guide surface. Yet further, the core-insertion hole is configured in a shape allowing an axial movement of the iron core but preventing an angular or rotational displacement of the iron core with respect to the core-insertion hole. Preferably, the iron core has a rectangular cross section and the core-insertion hole has a polygonal cross section.

According to the features of the preferred embodiments, the primary coil comprises an outermost layer and a plurality of inner layers. Each inner layer is formed into a dense alignment winding layer formed by winding a self-bonding type wire rod in such a manner that adjacent wire rods are brought into contact with each other in each inner layer, while the outermost layer is formed by winding the wire rod into the dense alignment winding layer only at both ends thereof and into a non-dense alignment winding layer in a middle portion thereof so that adjacent wire rods of the outermost layer can be spaced from each other at the middle portion.

Preferably, the both ends of the outermost layer are formed into the dense alignment winding layer by winding the wire rod by two terns or more.

According to the features of the preferred embodiments of the present invention, the coil body comprises a circuit housing for accommodating an ignitor circuit and the primary and secondary coils therein, and a connector formed in the vicinity of an opening portion of the circuit housing. The connector has connector terminals extending perpendicularly to an insertion direction of the ignitor circuit along which the ignition circuit is inserted into the circuit housing.

The ignitor circuit comprises circuit terminals extending into the opening portion of the circuit housing, while the connector terminals extend into the opening portion of the circuit housing and are connected to the circuit terminals.

The circuit terminals are disposed in a row on an end surface of the ignitor circuit closer to the opening portion of the circuit housing. Each circuit terminal has a flat surface portion parallel to the insertion direction of the ignitor circuit and an axial direction of each connector terminal. The connector terminal has a first flat surface portion and a second flat surface portion. The first flat surface portion is parallel to an aligning direction of the circuit terminals and the axial direction of the connector terminal. The second flat surface portion is disposed in parallel with the flat surface portion of the circuit terminal and connected to this flat surface portion.

Furthermore, according to a second aspect of the present invention, the ignition coil for an internal combustion engine comprises a primary coil and a secondary coil provided around the primary coil. The primary coil comprises an outermost layer and a plurality of inner layers, each of the inner layers is a dense alignment winding layer formed by winding a self-bonding type wire rod in such a manner that adjacent wire rods are brought into contact with each other in each layer, while the outermost layer is formed by winding the wire rod into the dense alignment winding layer only at both ends thereof and into a non-dense alignment winding layer in a middle portion thereof so that adjacent wire rods of the outermost layer can be spaced from each other at the middle portion.

Yet further, according to a third aspect of the present invention, the ignition coil for an internal combustion engine comprises an ignition coil, an ignitor circuit comprising a semiconductor element for controlling intermittent supply of a primary current to the ignition coil, a circuit housing for accommodating the ignitor circuit therein, and a connector disposed in the vicinity of an opening portion of the circuit housing and having connector terminals electrically connected to the ignitor circuit. The connector terminals extend perpendicularly to an insertion direction of the ignitor circuit along which the ignition circuit is inserted into the circuit housing.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
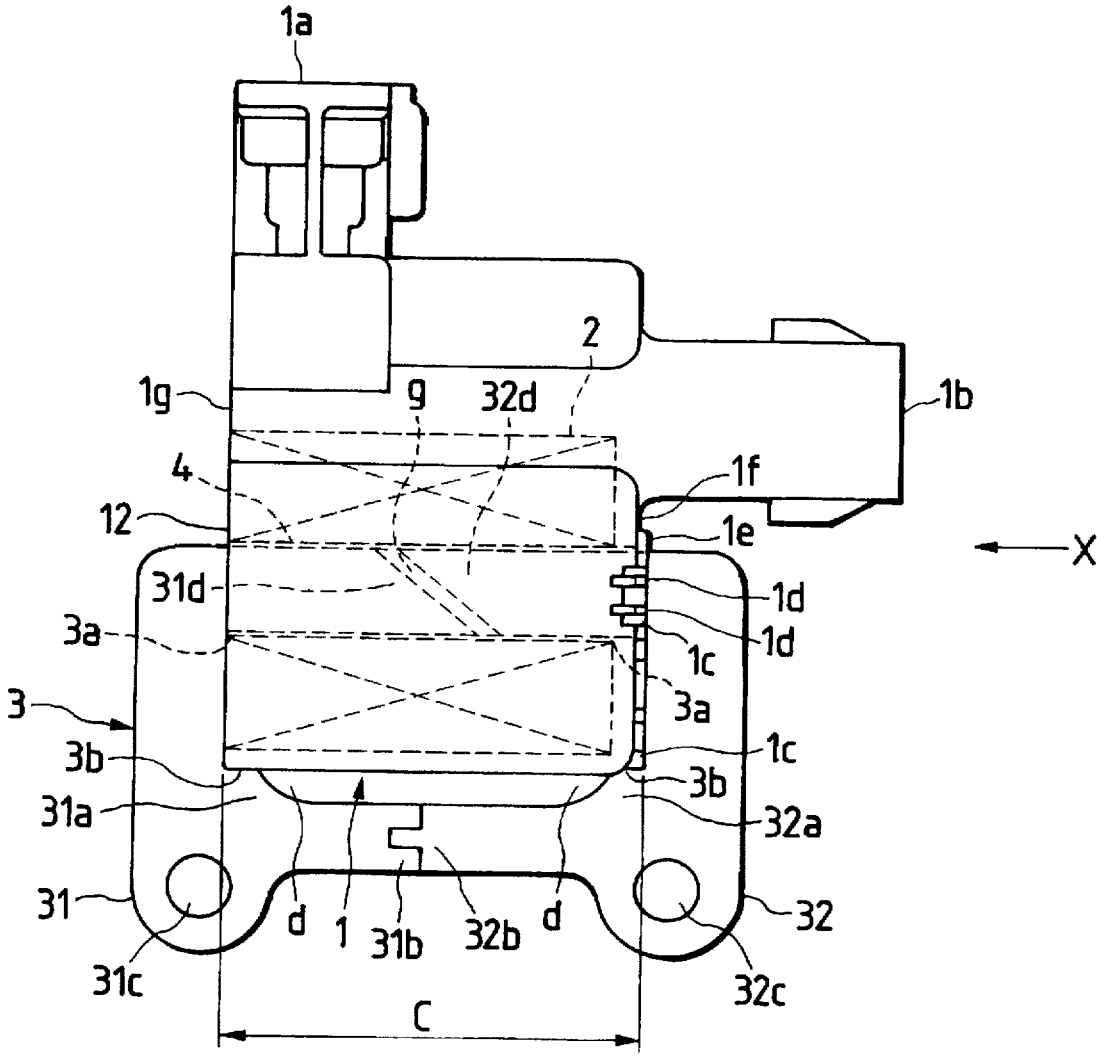
FIG. 1 is a front view showing an arrangement of an ignition coil, preferably used in an internal combustion engine, in accordance with a first embodiment of the present invention.

Preferred embodiments of the present invention will be explained in greater detail hereinafter, with reference to the accompanying drawings. Identical parts are denoted by the same reference numerals throughout views.

First Embodiment

FIG. 1 is a front view showing an arrangement of an ignition coil, preferably used in an internal combustion engine, in accordance with a first embodiment of the present invention. The ignition coil is normally installed closely to the body of an internal combustion engine in an engine compartment of an automotive vehicle to boost the low voltage of an associated battery to a high voltage so that the ignition plug can generate a sufficiently strong spark.

In FIG. 1, a coil casing i of the ignition coil is shaped into a rectangular cylindrical body having a bottom. This coil casing i is a resin product having an excellent insulating ability, such as polybutylene terephthalate. Coil casing 1 is integrally formed with a connector la and a high-voltage terminal 1*b*. Connector 1*a* is connectable with a battery (not shown), while high-voltage terminal 1*b* generates a high voltage.

A cylindrical coil 2 is a well-known type coil which boosts a voltage applied to its primary winding (i.e. primary coil) by its secondary winding (i.e. secondary coil). This coil 2 is assembled into coil casing 1. Furthermore, the primary winding of coil 2 is connected to a terminal (later-described) provided in the connector 1*a*. On the other hand, the secondary winding is connected to a terminal (later-described) provided in the high-voltage terminal 1*b*. A winding method for the primary winding will be described later in detail.

After coil 2 is assembled or installed in coil casing 1, the inside space of coil casing 1 is filled with epoxy group resin by injecting or introducing this epoxy group resin under a vacuum atmosphere. With this addition of resin material, coil 2 is firmly connected or fixed with coil casing 1, thereby forming a coil body 12.

Figure 2:
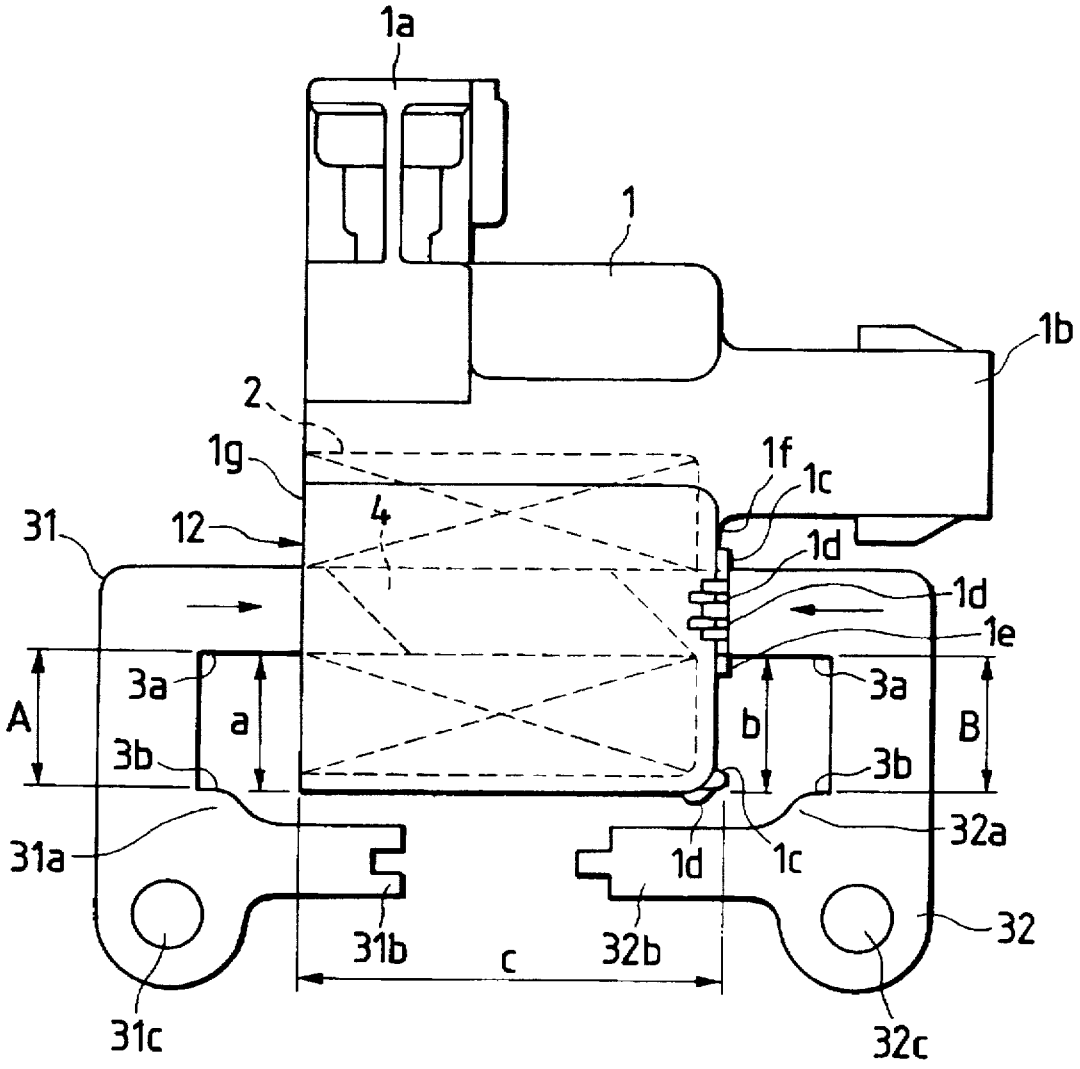
FIG. 2 is a front view showing an installation condition of the ignition coil shown in FIG. 1.

An iron core 3 forms a magnetic path of magnetic flux generated from coil 2. This iron core 3 is formed by laminating plural electromagnetic steel plates so as to have a square cross section. Before installation, this iron core 3 is separated into a first iron core 31 and a second iron core 32 having a symmetrical C-shaped configuration, as shown in FIG. 2. When these first and second iron cores 31 and 32 are assembled, upper limbs bifurcated from first and second iron cores 31 and 32 are inserted into a cylindrical core-insertion hole 4 from opposed ends of the insertion hole 4. This core-insertion hole 4 is integrally formed with coil casing 1 at its bottom surface 1*f*. The other (lower) bifurcated limbs of first and second iron cores 31 and 32 are coupled with each other. Thus, coil 2 and iron core 3 are interlinked each other so as to form a closed magnetic path. The core-insertion hole 4 serves as a bobbin of the primary winding.

A left side radial size "a" of coil casing 1, i.e. a radial distance at the left side between the inside cylindrical wall of core-insertion hole 4 and the outer cylindrical wall of coil casing 1, is slightly larger than a widthwise or lateral size "A" of a recessed engaging portion of C-shaped first iron core 31 corresponding or facing to the portion denoted by "a" size. Hence, in the assembled condition shown in FIG. 1, first iron core 31 is forcibly and firmly engaged with coil casing 1 by its parallel bifurcated limbs bridging or clamping between the inside cylindrical wall of core-insertion hole 4 and the outer cylindrical wall of coil casing 1.

Similarly, a right side radial size "b" of coil casing 1, i.e. a radial distance at the right side between the inside cylindrical wall of core-insertion hole 4 and the outer cylindrical wall of coil casing 1, is slightly larger than a widthwise or lateral size "B" of a recessed engaging portion of C-shaped second iron core 32 corresponding or facing to the portion denoted by "b" size. Hence, in the assembled condition shown in FIG. 1, second iron core 32 is forcibly and firmly engaged with coil casing i by its parallel bifurcated limbs bridging or clamping between the inside cylindrical wall of core-insertion hole 4 and the outer cylindrical wall of coil casing 1. In other words, two parallel ridges 3*a* and 3*b* formed at both ends of the recessed engaging portion of each C-shaped iron core 31 or 32 are forcibly and firmly engaged between the inside cylindrical wall of core-insertion hole 4 and the outer cylindrical wall of coil casing 1.

An axial size "c" of coil casing 1 is slightly larger than an axial size "C". This size "C" is a distance between first and second iron cores 31 and 32 in a condition where they are assembled or installed in coil casing 1 as shown in FIG. 1. When first and second iron cores 31 and 32 are assembled in coil casing 1, both iron cores 31 and 32 are just fitted to the side surfaces of coil casing 1 opposed in the axial direction.

A slant guide surface 31*a* is provided adjacently to and continuously from parallel ridge 3*b* on the lower limb of first iron core 31, while a similar slant guide surface 32*a* is provided adjacently to and continuously from parallel ridge 3*b* on the lower limb of second iron core 32. Thus, the widthwise or lateral distance d between two bifurcated limbs of each C-shaped iron core 31 or 32 is enlarged at the portion corresponding to slant guide surface 31*a* or 32*a*, respectively. A slant surface 31*d*, inclined at a predetermined angle with respect to the axial direction, is formed at the distal end of the upper limb of first iron core 31. A slant surface 32*d*, inclined in parallel with slant surface 31*d*, is formed at the distal end of the upper limb of second iron core 32. A slight gap "g" is provided between these two parallel slant surfaces 31*d* and 32*d* in the assembled condition shown in FIG. 1. A concave portion 31*b* is formed at the distal end of the lower limb of first iron core 31. A convex portion 32*b*, engageable with the concave portion 31*b*, is formed at the distal end of the lower limb of second iron core 32. A through-hole 31*c* of first iron core 31 and a through-hole 32*c* of second iron core 32 are holes for fixing the ignition coil onto the body of the automotive vehicle.

Figure 3:
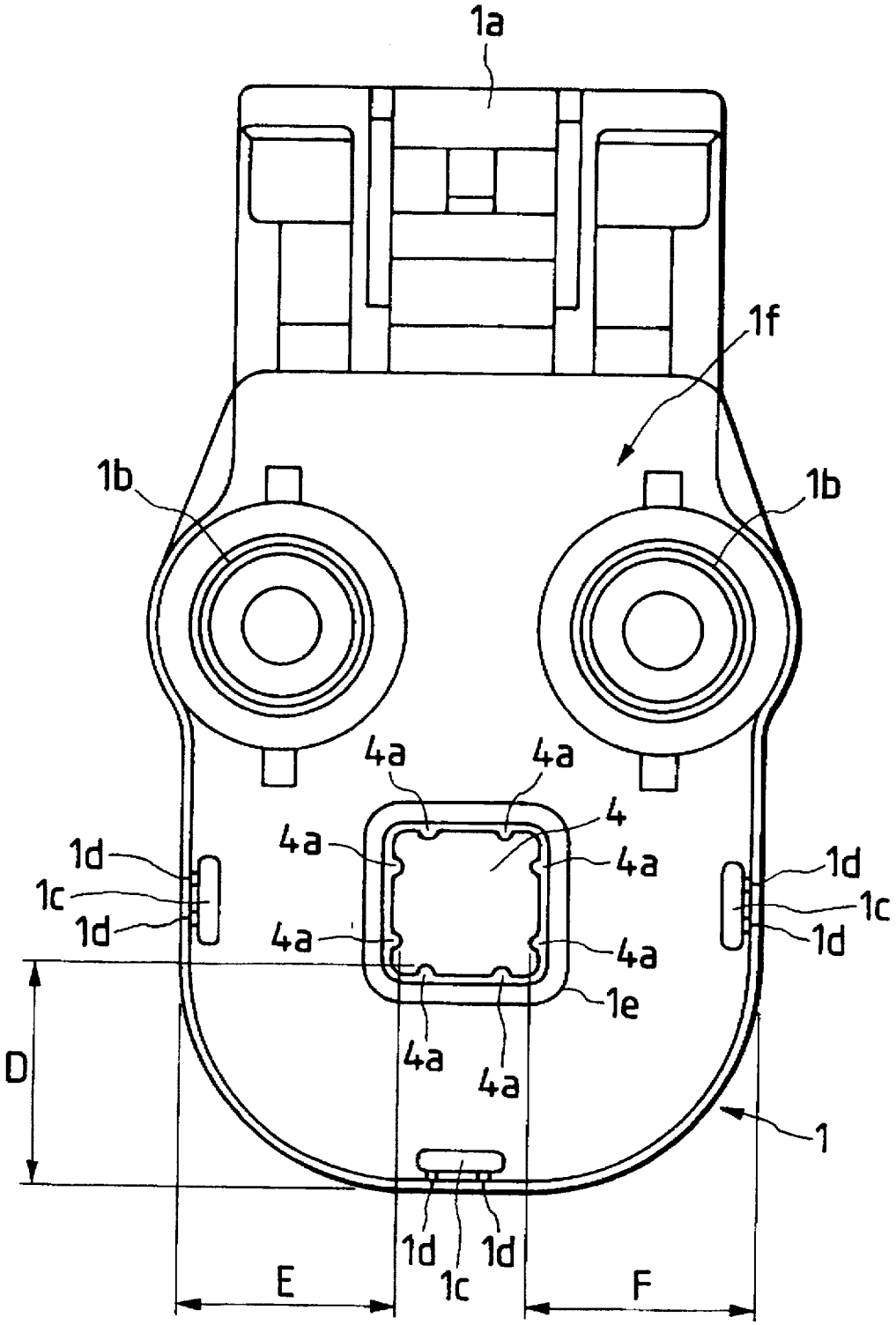
FIG. 3 is a side view showing a coil casing of the ignition coil shown in FIG. 1, seen from a direction X of FIG. 1.

As shown in FIG. 3, a total of three protrusions 1*c* are provided on bottom surface if of coil casing i at the region where they are forcibly and firmly brought into contact with parallel ridge 3*b*, so as to protrude slightly from the bottom surface if in the axial direction of coil 2. These protrusions 1*c* are equally spaced from the core-insertion hole 4, each protrusion 1*c* extends in parallel with a facing side wall of core-insertion hole 4. With provision of these protrusions 1*c*, coil casing 1 is brought into contact with second iron core 32. In other words, the contact area between coil casing 1 and second iron 32 is as small as the total area of these three protrusions 1*c*.

Two guide ridges 1*d* are formed on an outer surface of each protrusion 1*c*, so as to extend in the axial direction of coil 2. The radial height of each guide ridge 1*d* increases as it approaches from the distal end to the base of protrusion 1*c*. The contact area between guide ridge 1*d* and second iron core 32 is smaller than the area of slant guide surface 32*a*.

Core-insertion hole 4 has a square cross section as shown in FIG. 3. On each side wall of this core-insertion hole 4, there are provided two parallel ridges 4*a* extending thoroughly in the axial direction of the coil 2 (i.e. axial direction of core-insertion hole 4). Each ridge 4*a* is provided near but offset slightly from the corner of core-insertion hole 4. A gap between confronting apexes of ridges 4*a* formed on opposing side walls of core-insertion hole 4 is slightly smaller than the width of one side of iron core 3 (i.e. first iron core 31 or second iron core 32). The contact area between ridges 4*a* and iron core 3 is smaller than the area of core-insertion hole 4.

As shown in FIG. 1, a rectangular flange 1*e*, protruding slightly in the axial direction of coil 2, is provided on bottom surface if of coil casing 1 along the periphery of the opening of core-insertion hole 4. The axial protruding size of rectangular flange 1*e* is identical with that of protrusion 1*c*.

As shown in FIG. 3, a distance "D" represents a size from a bottom wall of core-insertion hole 4 to a corresponding bottom outer wall of coil casing 1. A distance "E" represents a size from a front side wall of core-insertion hole 4 to a corresponding front outer wall of coil casing 1. And, a distance "F" represents a size from a rear side wall of core-insertion hole 4 to a corresponding rear outer wall of coil casing 1. These distances "D", "E" and "F" are identical with each other.

Next, characteristic features of the above-described embodiment will be explained.

As explained above, the left side radial size "a" of coil casing 1, i.e. the radial distance from the inside cylindrical wall of core-insertion hole 4 to the outer cylindrical wall of coil casing i along the left side of coil casing 1, is slightly larger than the widthwise or lateral size "A" of the recessed engaging portion of C-shaped first iron core 31. Hence, in the assembling, first iron core 31 is forcibly and firmly engaged with coil casing 1 by its parallel bifurcated limbs bridging or clamping between the inside cylindrical wall of core-insertion hole 4 and the outer cylindrical wall of coil casing 1.

Similarly, the right side radial size "b" of coil casing 1, i.e. the radial distance from the inside cylindrical wall of core-insertion hole 4 to the outer cylindrical wall of coil casing 1 along the right side of coil casing 1, is slightly larger than the widthwise or lateral size "B" of the recessed engaging portion of C-shaped second iron core 32. Hence, in the assembling, second iron core 32 is forcibly and firmly engaged with coil casing 1 by its parallel bifurcated limbs bridging or clamping between the inside cylindrical wall of core-insertion hole 4 and the outer cylindrical wall of coil casing 1.

More specifically, the above-described precise settings of these sizes "a", "A", "b" and "B" makes it sure that two parallel ridges 3*a* and 3*b* formed at both ends of the recessed engaging portion of each C-shaped iron core 31 or 32 are forcibly and firmly engaged between the inside cylindrical wall of core-insertion hole 4 and the outer cylindrical wall of coil casing 1.

Accordingly, when coil body 12 is subjected to vibrations acting in the radial direction of coil 2, it is possible to surely fix iron cores 3 in the coil body 12 without causing an undesirable loose or disengagement due to these vibrations.

Meanwhile, when coil body 12 is subjected to the vibrations acting in the axial direction of coil 2, it is possible to firmly fix iron cores 3 in the coil body 12 by the frictional force derived from forcible contact between iron cores 3 and coil body 12. In short, anti-vibration ability is assured for the engagement between coil body 12 and iron cores 3 satisfactorily against any directional vibrations.

Furthermore, the arrangement of iron cores 3 clamping the axial ends of the outer wall of coil casing 1 is effective to surely prevent the iron cores 3 from being loosened or disengaged from coil body 12 when coil casing 1 is subjected to the vibration acting in its axial direction.

Two guide ridges 1*d* are formed on the outer surface of each protrusion 1*c*, i.e. of coil casing 1. The contact area between these guide ridges 1*d* and iron cores 3 are small enough to increase the surface pressure acting on guide ridge 1*d*. It means that guide ridge 1*d* is easily deformable compared with coil casing i itself. In other words, iron cores 3 can be engaged with coil casing 1 without casing a large deformation of coil casing 1.

In addition, the pressing force of iron cores 3 is chiefly received by these guide ridges 1*d*, removing any excessive force acting on coil casing 1. Hence, it becomes possible to prevent any excessive force from acting on coil casing 1, coil 2 and copper winding in coil casing 1. Consequently, anti-vibration ability of the ignition coil for an internal combustion engine can be improved.

Guide ridges 1*d* are provided only at the bottom surface if side of coil casing 1. This arrangement is based on the following fact. Namely, coil casing 1 is rigid at its bottom surface if side compared with its opposing opening 1*g* side. This is why the easily deformable guide ridges 1*d* are provided at the bottom side of coil casing 1 to compensate such a poor deformability of the bottom side of coil casing 1. Hence, coil casing 1 is easily inserted and clamped between two parallel bifurcated limbs of iron core 32. Furthermore, a clamping force applied on iron core 32 cab be set as an adequate value. Although not shown, it is of course possible to provide similar deformable ridges at the opening 1*g* side of coil casing 1 if required.

Still further, three protrusions 1*c* are provided on bottom surface 1*f* of coil casing 1 so as to protrude slightly from the bottom surface if in the axial direction of coil 2 at the region where they are forcibly and firmly brought into contact with parallel ridge 3*b*. The contact area between coil casing i and second iron 32 is as small as the total area of these three protrusions 1*c*. Hence, the surface pressure acting on the top of each protrusion 1*c* is so increased that each protrusion can be easily deformed compared with other portions. Accordingly, it becomes possible to forcibly and firmly engage iron cores 3 with coil body 12 without causing a large deformation of coil casing 1.

Yet further, there are provided slant guide surfaces 31*a* and 32*a* adjacently to and continuously from parallel ridges 3*b* on the lower limbs of iron cores 31 and 32, so that the widthwise or lateral distance between two bifurcated limbs of each C-shaped iron core 31 or 32 is enlarged at the portion corresponding to slant guide surface 31*a* or 32*a*, respectively.

Provision of these slant guide surfaces 31*a* and 32*a* is effective to realize the smooth insertion of first and second iron cores 31 and 32 into coil casing 1. Hence, installation can be facilitated and installation time can be shortened, realizing the reduction of manufacturing costs for an ignition coil of an internal combustion engine.

Moreover, iron core 3 and core-insertion hole 4 have a square cross section. Such a square configuration is effective to generate a counter force (torque) acting against a rotational force (torque) when applied about the axis of coil 2. Accordingly, it becomes possible to firmly fix coil 2 with coil casing 1 without any undesirable loose or disengagement even when such a rotational force is applied.

Figure 4:
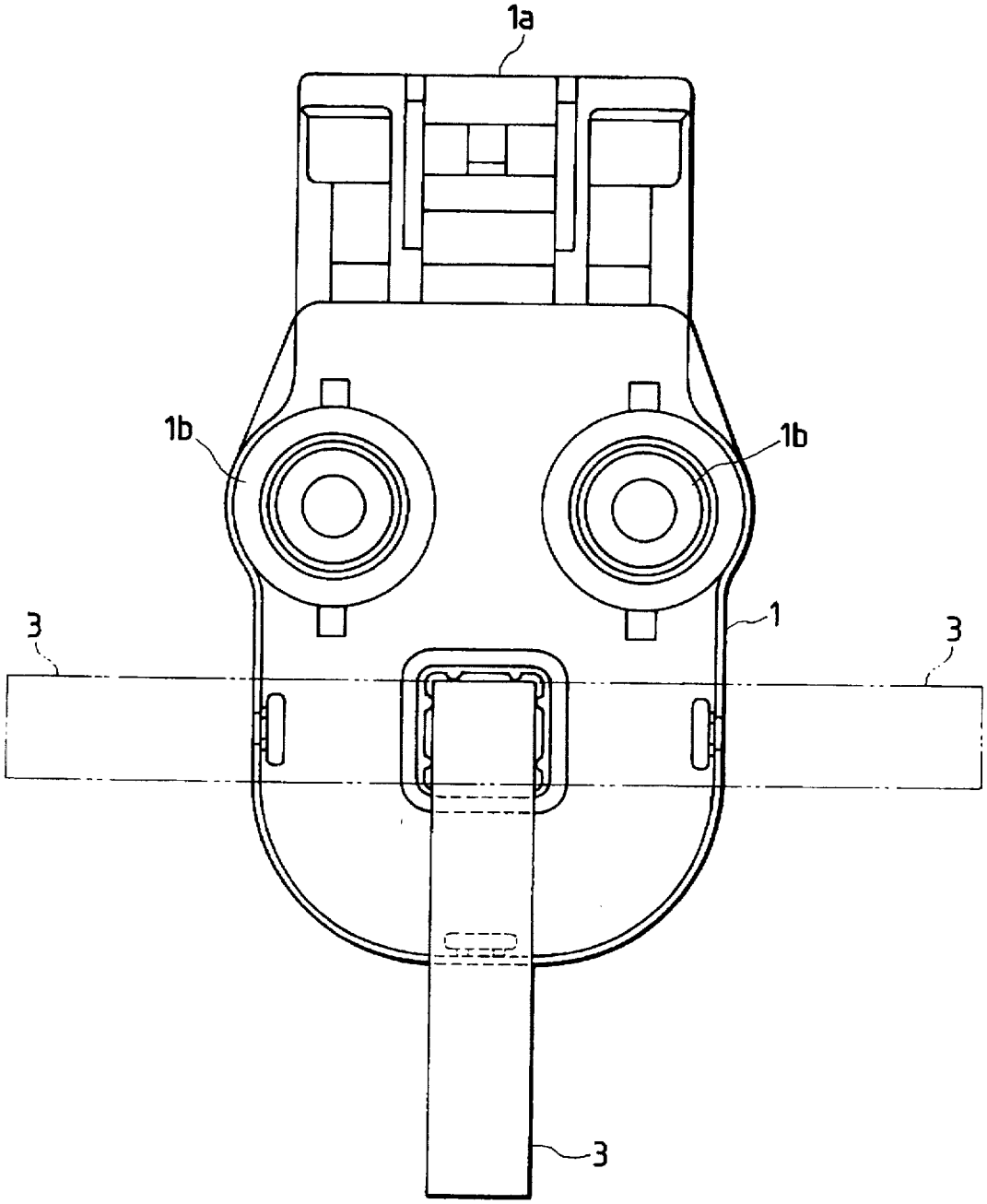
FIG. 4 is a side view similar to FIG. 3 but showing an installation condition of an iron core.

Furthermore, according to the arrangement of the present embodiment, it becomes possible to arbitrarily change the coupling angle of each iron core 3 with respect to core-insertion hole 4 of coil 2 as illustrated FIG. 4. In other words, the layout of this ignition coil can be flexibly changed when this ignition coil is installed on an internal combustion engine to be positioned in a crowded space of an engine room of an automotive vehicle, resulting in the increase of designing efficiency.

Still further, on each side wall of the rectangular core-insertion hole 4, there are provided two parallel ridges 4*a* extending thoroughly in the axial direction of the coil 2 (i.e. axial direction of core-insertion hole 4). The gap between confronting ridges 4*a* formed on opposing side walls of core-insertion hole 4 is slightly smaller than the width of one side of iron core 3. Furthermore, the contact area between ridges 4*a* and iron core 3 is smaller than the area of core-insertion hole 4. Accordingly, the surface pressure between iron core 3 and ridges 4*a* can be increased. Iron core 3 can be forcibly and firmly inserted into core-insertion hole 4, surely clamping it by ridges 4*a*.

Figure 5:
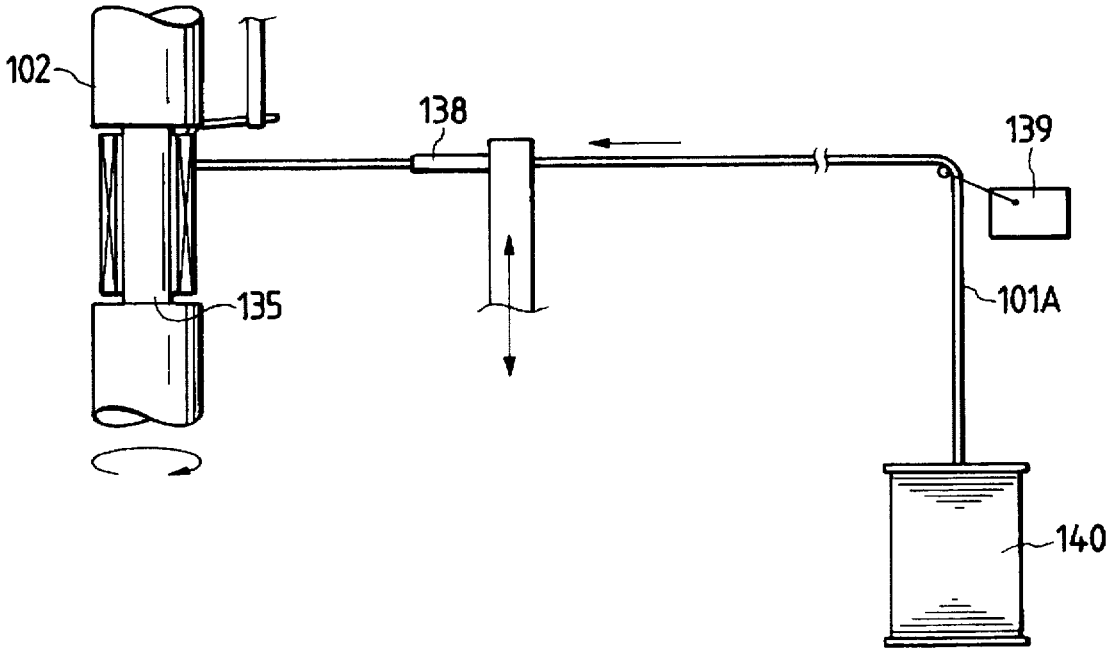
FIG. 5 is a schematic view showing a winding apparatus used for fabricating the ignition coil in accordance with the present invention.

Next, the winding method for the primary winding (primary coil) will be explained in greater detail with reference to FIGS. 5 to 9. FIG. 5 is a schematic view showing a winding apparatus in accordance with the present invention. As shown in FIG. 5, wire rod 101A made of copper wire is supplied from wire bobbin 140. A leading edge of wire rod 101A is temporarily connected to a winding jig 102 having a winding shaft 135. By rotating this winding jig 102, wire rod 101A is wound around winding shaft 135. A nozzle 138, causing a reciprocative movement in the up-and-down direction, controls the feed position of wire rod 101A. A tension device 139, interposed between nozzle 138 and wire bobbin 140, is provided to adjust the tension of wire rod 101A.

Figure 6:
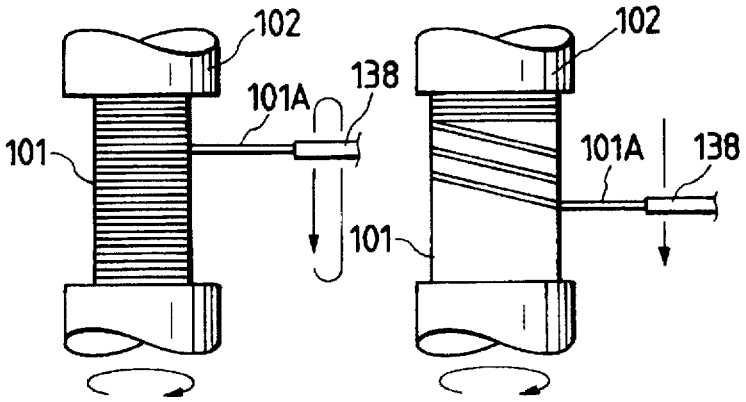
FIG. 6 is a view illustrating the movement of a nozzle the winding apparatus during the winding operation of a wire rod.

FIG. 6 is a view illustrating the movement of nozzle 138 during the winding operation of wire rod 101A. A bobbinless coil 101 is fabricated by winding wire rod 101A directly on the cylindrical body of winding jig 102 serving as a bobbin. In forming a multi-layer arrangement of a bobbinless coil 101, a "dense alignment winding" method is applied to first to third inner layers, as shown in the left side of FIG. 6. More specifically, a feed amount of wire rod 101A by nozzle 138 per complete rotation of winding jig 102 is equivalent to the diameter of wire rod 101A, thereby constructing the densely aligned first to third inner layers of bobbinless coil 101 wherein adjacent wire rod are brought into contact with each other in each layer. Regarding the outermost layer of this bobbinless coil 101, the "dense alignment winding" method is applied to only the end part of the layer. That is, in winding wire rod 101A around winding jig 102 at both ends of the outermost layer, nozzle 138 is shifted by the amount equivalent to the diameter of wire rod 101A per complete rotation of winding jig 102. However, in the middle part of shaft 135 of winding jig 102, nozzle 138 increases the feed amount of wire rod 101A to an amount larger than the diameter of wire rod 101A per complete rotation of winding jig 102, thereby performing a non-dense alignment winding as shown in the right side of FIG. 6.

Figure 7:
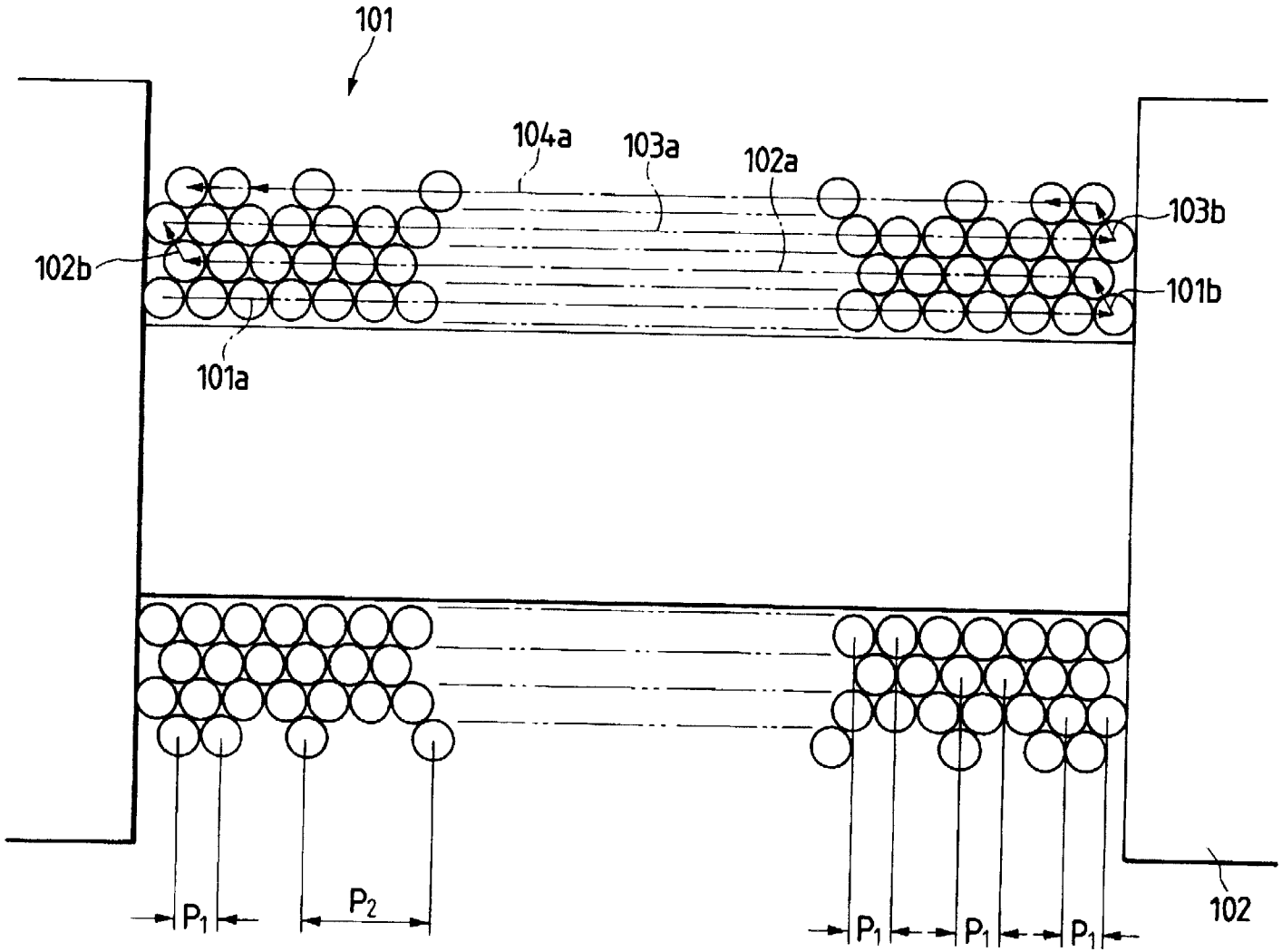
FIG. 7 is a view illustrating details of the winding operation of the nozzle of the winding apparatus.

FIG. 7 is a view illustrating details of the winding operation of nozzle 138. As shown in FIG. 7, the first inner layer is formed into a dense alignment winding layer by feeding wire rod 101A along a path 101*a* by a pitch P1 equivalent to the diameter of wire rod 101A. Wire rod 101A is then shifted along a path 101*b* to transfer wire rod 101A to the second inner layer. The second inner layer is also formed into a dense alignment winding layer by feeding wire rod 101A in an opposed direction along a path 102*a* with the same pitch P1. Similarly, the third layer is formed into a dense alignment winding layer by passing through a route designated by 102*b* and 103*a* with the pitch However, the winding method for the outermost (i.e. fourth) layer is different from these first to third layers. After wire rod 101A is transferred to the fourth layer via a path 103*b*, wire rod 101A is partly wound into a dense alignment winding layer with pitch P1 at the end part by only two turns or more. Then, wire rod 101A is wound by a pitch P2 (P1<P2) in the middle of a path 104*a*, thereby performing the non-dense alignment winding. Finally, at the opposite end, wire rod 101A is again wound into a dense alignment winding layer with pitch P1 by only two turns or more.

Figure 8A:
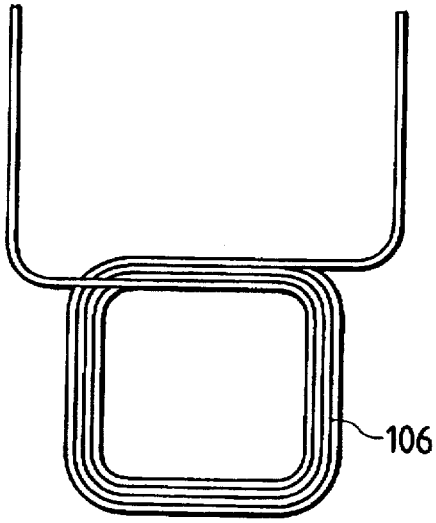
FIGS. 8A and 8B are views cooperatively showing a bobbinless coil fabricated by the winding method of the present invention.
Figure 8B:
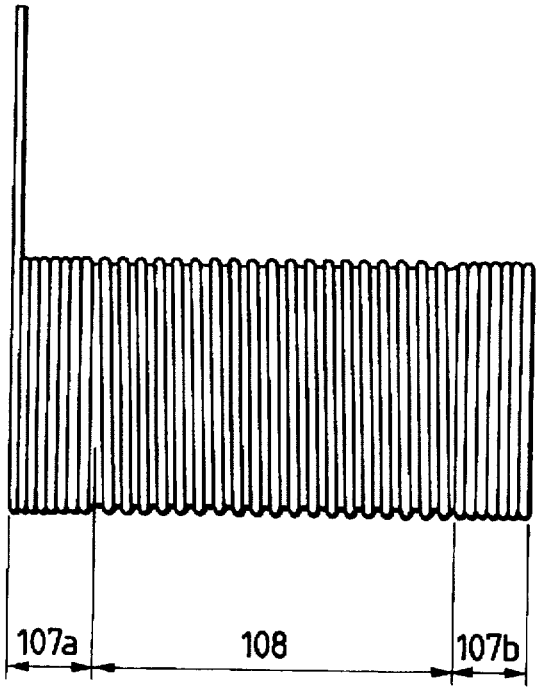

FIGS. 8A and 8B are views cooperatively showing bobbinless coil 101 fabricated by the winding method explained with reference to FIGS. 8 and 7. As shown in these drawings, the outermost layer 108 has opposing end parts 107*a* and 107*b* applied the dense alignment winding and a middle part 108 applied the non-dense alignment winding.

Figure 9:
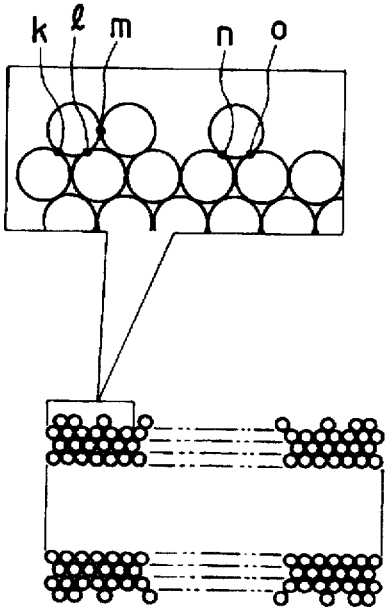
FIG. 9 is a view illustrating the effect of the winding method of the present invention.

FIG. 9 is a view illustrating the effect of the winding method of the present invention. As shown in FIG. 9, the fourth-layer wire rod can contact at three points k, i and m with adjacent third-layer wire rods in the dense alignment winding region corresponding to end parts 107*a* and 107*b*. Meanwhile, the fourth-layer wire rod can contact at two points n and o with adjacent third-layer wire rods in the non-dense alignment winding region corresponding to middle part 108. With this winding method, it becomes possible to maintain the configuration or appearance of bobbinless coil 101 because rigidity is chiefly maintained at the both ends parts 107*a* and 107*b*. Hence, it becomes possible to realize an automatic assembling of bobbinless coil 101 using a self-bonding type wire rod, as well as automatic wire connection. This winding method is preferably applied to copper wire having a diameter not smaller than 0.2 mm.

Figure 10:
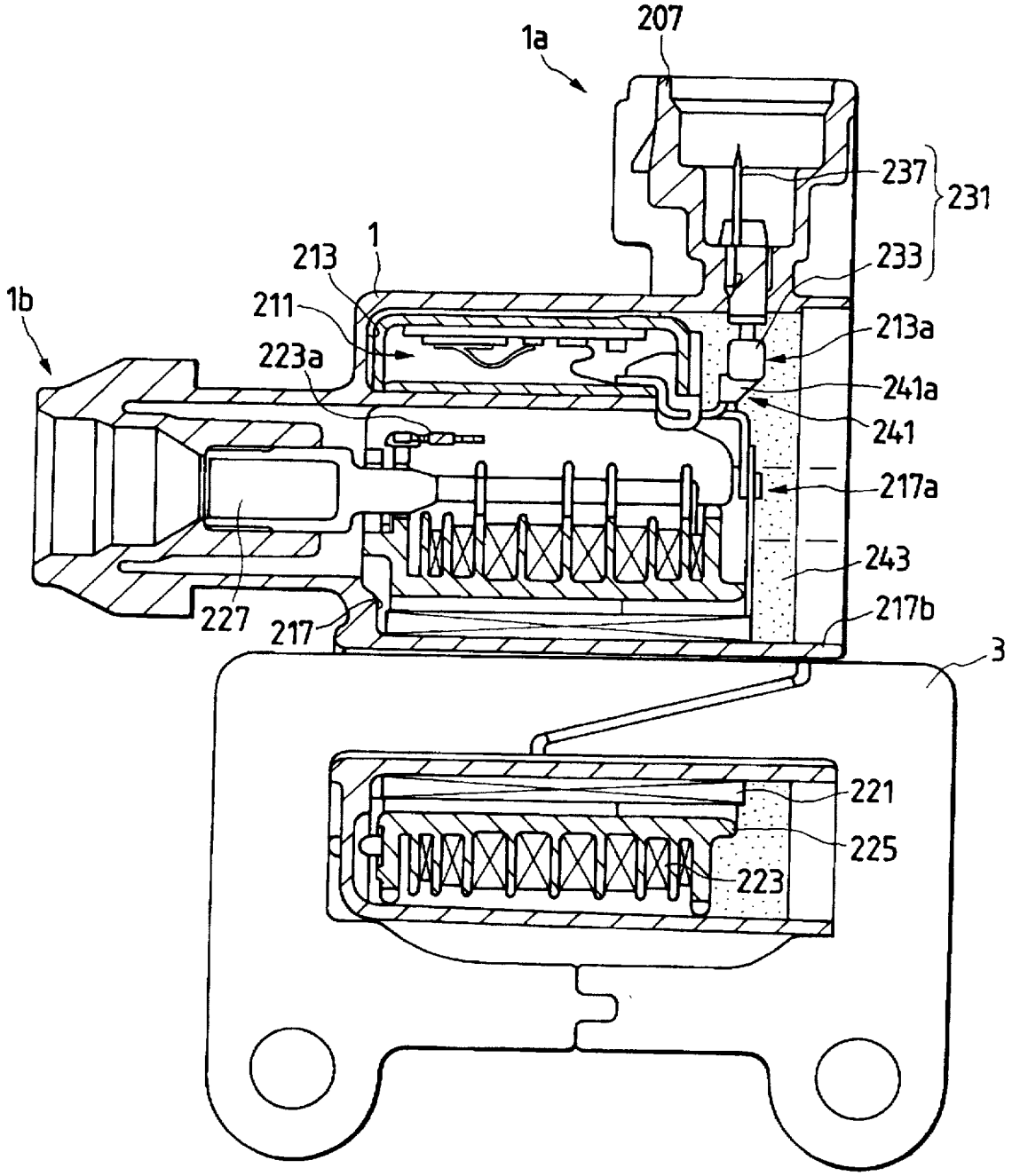
FIG. 10 is a cross-sectional view showing the detailed arrangement of the ignition coil in accordance with the first embodiment of the present invention.

Next, the arrangement of coil casing 1 of the first embodiment of the present invention will be explained in greater detail with reference to the accompanying drawings. FIG. 10 is a cross-sectional view showing an arrangement of the ignition coil embodying the present invention. Coil casing 1, serving as a circuit housing, is a resin product integrally formed with a shell 207 of connector 1*a*. Coil casing 1 comprises an ignitor housing 213 and a coil housing 217 extending in parallel with each other in the direction normal to the axial direction of connector 1*a*. Ignitor housing 213 and coil housing 217 have opening portions 213*a* and 217*a* at the same side closely to shell 207. Ignitor housing 213 accommodates an ignitor 211 comprising at least a semiconductor switching element which intermittently controls the supply of the primary winding current to the ignition coil. Coil housing 217 accommodates a primary winding 221 and others. Ignitor housing 213 comprises a power transistor as the semiconductor switching element and a control circuit for controlling the primary winding current value.

Coil housing 217 comprises a primary bobbin 217*b* defining the above-described core-insertion hole 4. That is, primary bobbin 217*b* has a square cross section for receiving two separate C-shaped iron cores 3 (i.e. 31 and 32). Primary winding 221 is wound around primary bobbin 217*b*. Provided around the primary winding 221 is a secondary bobbin 225 wound by a secondary winding 223.

The above-described high-voltage terminal 1*b* is disposed adjacently to the bottom (i.e. the other side opposed to the opening portion 217*a*) of coil housing 217, and is integrally formed with the coil housing 217. A high-voltage metallic plate 227, fixed in the high-voltage terminal 1*b*, is connected to the secondary terminal 223*a* of secondary winding 223.

Figure 12A:
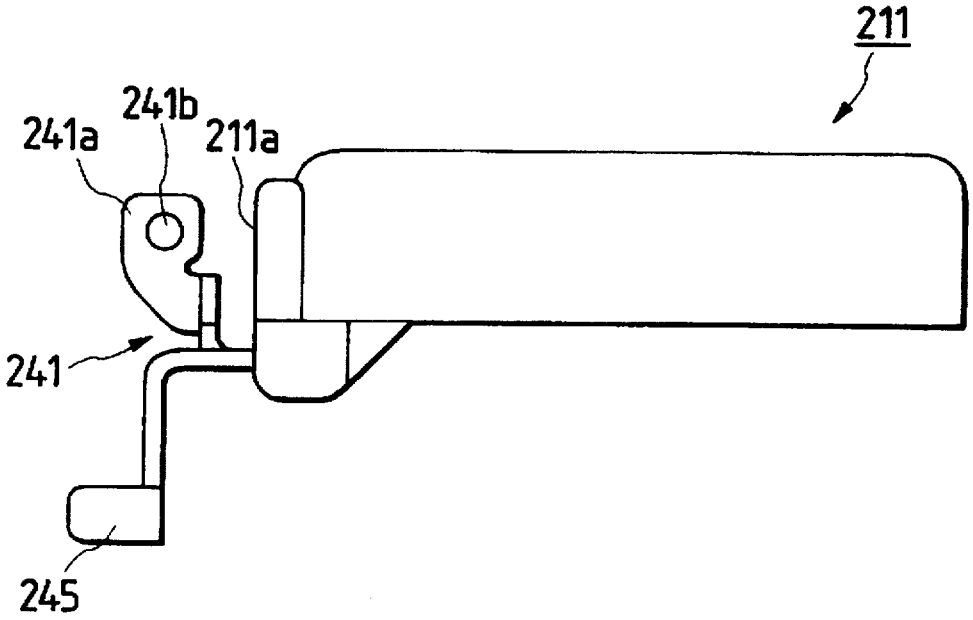
FIG. 12A is a bottom view showing an arrangement of an ignitor shown in FIG. 10.
Figure 12B:
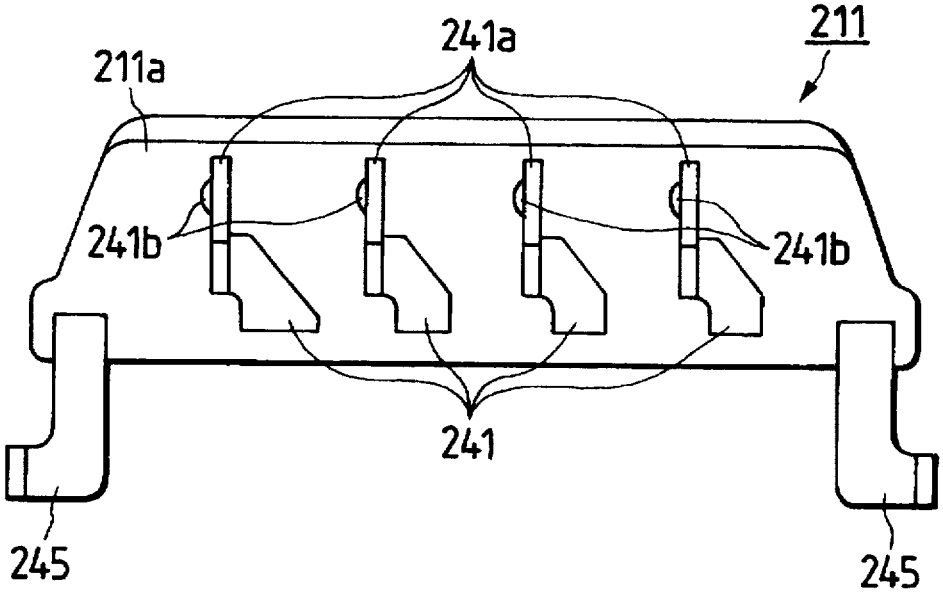
FIG. 12B is a right side view showing the same.

A total of four parallel pins 231, extending and reaching the center of opening portion 213*a*, are inserted into bottom holes of shell 207. As shown in FIGS. 12A and 12B, a total of four terminals 241 are provided in parallel with each other closely to an end surface 211*a* of ignitor 211 disposed at the same side as opening portion 213*a*. Each pin 231 has a base end connected to a second flat surface portion 233 extending in the axial direction of pin 231 toward opening portion 213*a*. Meanwhile, each terminal 241 has a flat surface portion 241*a* extending in the longitudinal direction (i.e. insertion direction) of ignitor 211. Flat surface portion 241*a* is parallel to the axis of pin 231.

Each flat surface portion 241*a* is welded firmly with its corresponding second flat surface portion 233 by the projection welding as described later. Furthermore, coil casing i is filled with resin 243 to cover ignitor 211, secondary winding 223 and others accommodated therein.

Figure 11A:
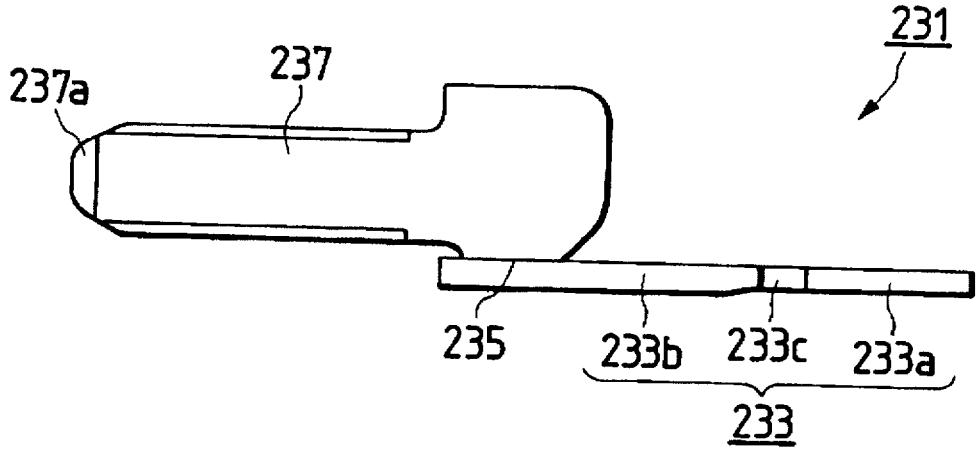
FIG. 11A is a right side view showing a connector pin shown in FIG. 10.
Figure 11B:
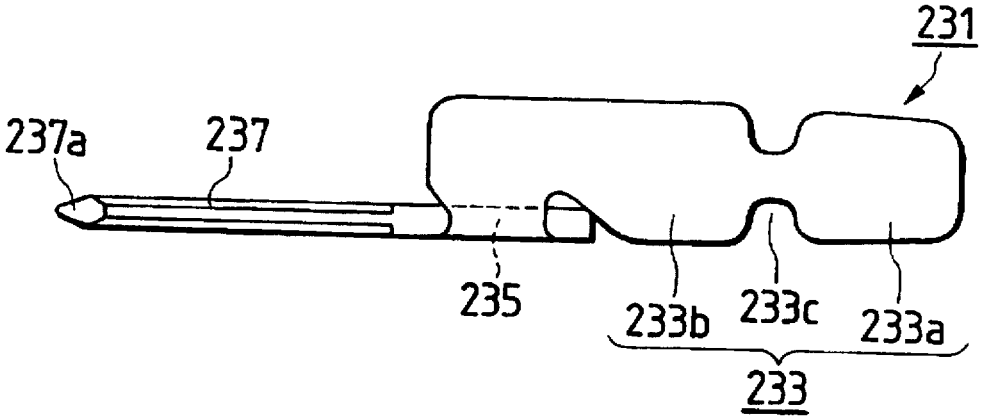
FIG. 11B is a front view showing the same.

Next, the arrangement of pin 231 and terminal 241 will be explained in greater detail. FIG. 11A is a right side view (a view seen from the right side of FIG. 10) of pin 231, while FIG. 11B is a front view (a view seen from the front of FIG. 10) of the same. As shown in FIGS. 11A and 11B, each pin 231 is angled with 90° by bending a plain metal plate along a predetermined folding line 235.

Each pin 231 chiefly consists of a first flat surface portion 237 and the above-described second flat surface portion 233. First flat surface portion 237, supported at its base and extending in the inside space of shell 207, has a distal end 237*a* tapered so that pin 231 can be easily inserted into a socket contact (not shown). First flat surface portion 237 is parallel to an aligning direction of terminals 241 and the axial direction of pin 231.

On the other hand, second flat surface portion 233 comprises a connecting portion 233*a* to be welded with a corresponding terminal 241 and a coupling portion 233*b* to be coupled with the base end of shell 207. Connecting portion 233*a* and coupling portion 233*b* is connected by a neck portion 233*c* having a narrower lateral width.

FIG. 12A is a bottom view showing an arrangement of ignitor 211, while FIG. 12B is a right side view showing the same. Ignitor 211 comprises a stainless container accommodating a hybrid circuit substrate fabricated by the thick-film technology. The hybrid circuit substrate in the stainless container is sealed with resin, so as to constitute an integrated circuit unit. Alternatively, it will be possible to apply a resin sealing to the entire surface of ignitor 211.

As shown in FIGS. 12A and 12B, four terminals 241 are positioned in a row closely to the end surface 211*a* of ignitor 211, at the same side as opening portion 213*a*. Each terminal 241, extending upward, has flat surface portion 241*a* disposed perpendicularly to the end surface 211*a*. A semi-spherical projection 241*b* is formed at the center of flat surface portion 241*a*. The reverse side of this semi-spherical projection 241*b* is recessed. A pair of primary terminals 245 are provided at opposite ends of the end surface 211*a*. These primary terminals 245 are connected to the both ends of primary winding 221.

According to the above-described ignition coil of the present embodiment, ignitor 211 controls the primary current of primary winding 221 based on a signal entered through pins 231 so that secondary winding 223 generates a high voltage. Then, ignitor 211 sends out the generated high-voltage output via high-voltage metallic plate 227 at predetermined timings to an ignition plug of an internal combustion engine (not shown), thereby performing an ignition operation of the internal combustion engine at desirable timings.

Furthermore, according to the ignition coil of the present embodiment, connector 1*a* is integrally formed with coil casing 1 and disposed in the vicinity of opening portion 213*a* of ignition housing 213. Pins 231 of connector 1*a* extend in the direction normal to the longitudinal direction of ignitor 211 so as to reach the opening portion 213*a*. Hence, these pins 231 can be directly connected with terminals 241. This is a useful arrangement not only in effectively utilizing the inside space of opening portion 213*a* but also in shortening the conductive path from pins 231 to terminals 241. Accordingly, it becomes possible to adequately reduce the size of coil casing 1. In other words, it becomes possible to provide a space for other accessory devices in the vicinity of the internal combustion engine in a narrow engine room of an automotive vehicle.

Figure 13:
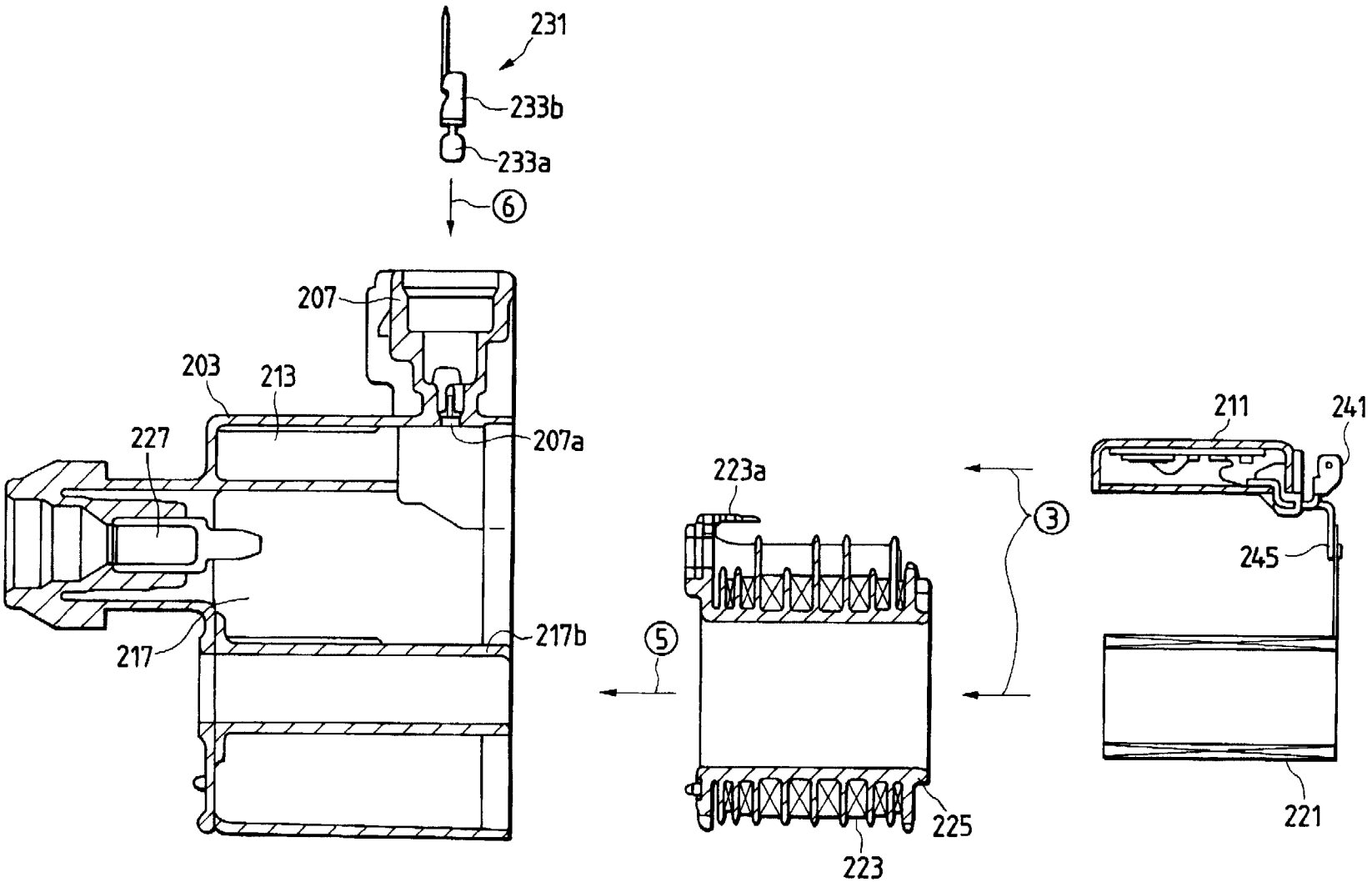
FIG. 13 is a view illustrating manufacturing steps of the ignition coil of the present invention.
Figure 14:
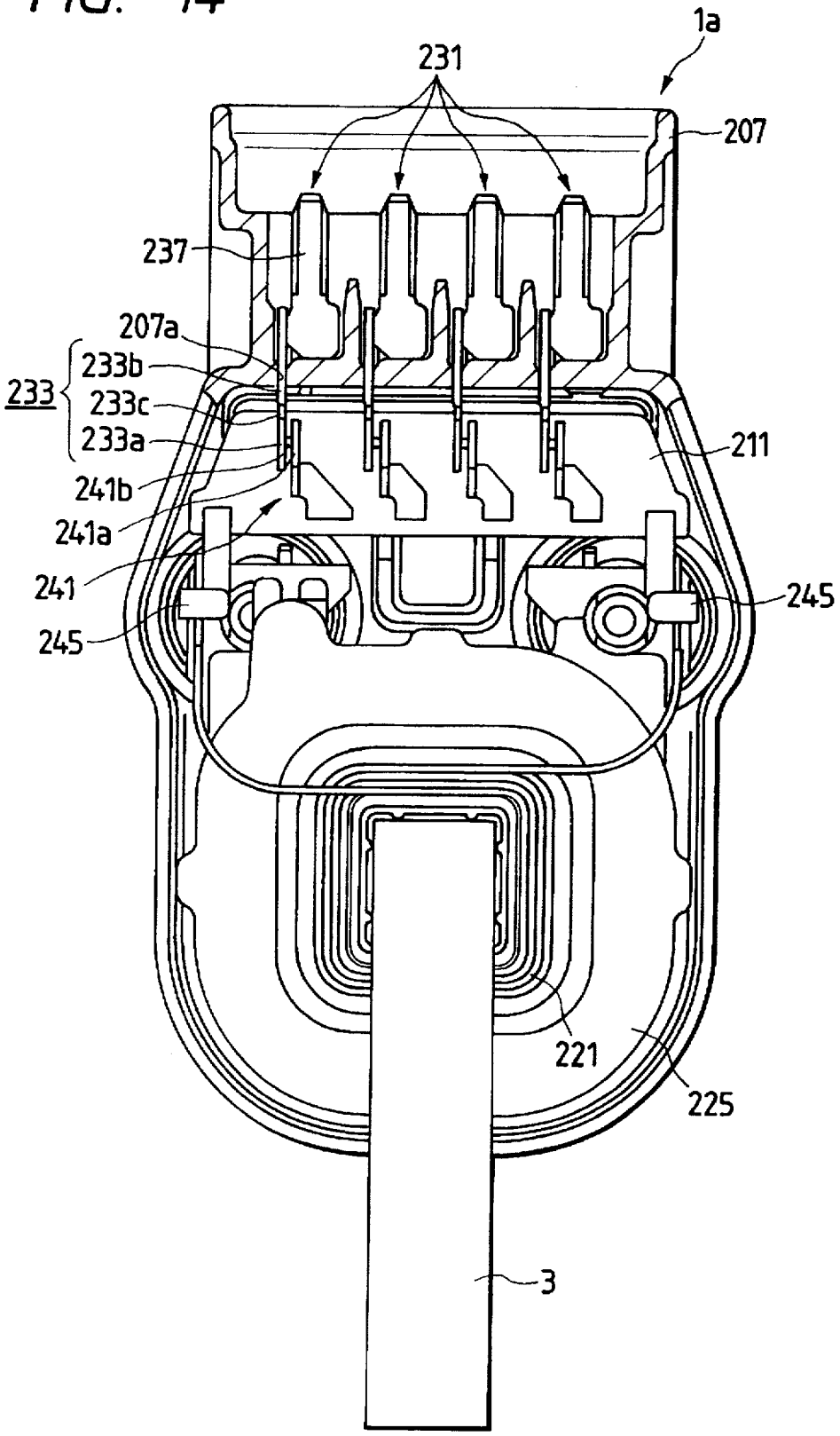
FIG. 14 is a side view showing the ignition coil of the first embodiment of the present invention.

A manufacturing method of the above-described ignition coil will be explained hereinafter with reference to FIGS. 13 to 15. FIG. 13 is a view illustrating manufacturing steps of the ignition coil of the present embodiment. The following is the procedure for manufacturing the ignition coil of the present embodiment.

I) Primary winding 221 is wound around primary bobbin 217*b*, and the both ends of primary winding 221 are connected to primary terminals 245 of ignitor 211.

II) Secondary winding 223 is wound around secondary bobbin 225, and the both ends of secondary winding 223 are connected to secondary terminals 223*a*.

III) Coil casing 1 and shell 207 are integrally formed by resin molding. Coupling holes 207*a* are opened at the bottom of shell 207, so that each pin 231 is supported to the bottom of shell 207 by coupling or engaging its coupling portion 233*b* with its corresponding coupling hole 207*a* of shell 207.

IV) The secondary winding 223 assembled in the above-described step II is inserted into coil housing 217 of coil casing 1 fabricated in the above-described step III, as indicated by an arrow (5).

V) Primary winding 221 and ignitor 211 united in the above-described step I is inserted into coil housing 217 and ignitor housing 213 of coil casing 1, as indicated by an arrow (3).

VI) Pins 231 are inserted from their connection portions 233*a* into coupling holes 207*a* of shell 207 formed in the above-described step III, as indicated by an arrow (8). When all pins 231 are completely coupled with shell 207 as shown in FIG. 14, semi-spherical projection 241*b* formed on flat surface portion 241*a* of each terminal 241 is brought into a closer and parallel confronting relation with connecting portion 233*a* of its corresponding pin 231. Coupling portion 233*b* of each pin 231 is hermetically engaged with its corresponding coupling hole 207*a*.

Figure 15:
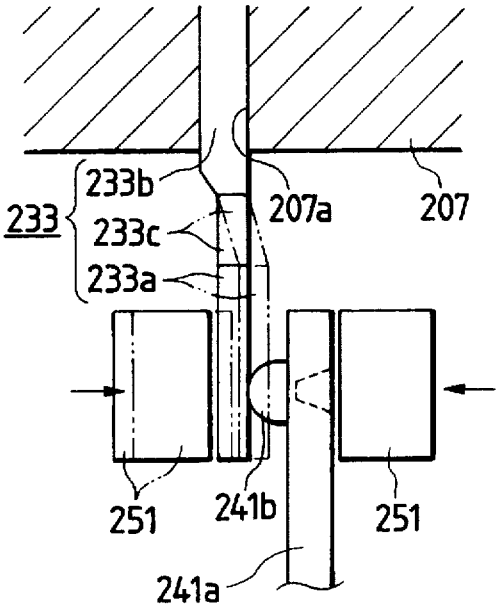
FIG. 15 is a view illustrating a projection welding applied to terminals of the ignition coil in accordance with the first embodiment of the present invention.
Figure 16:
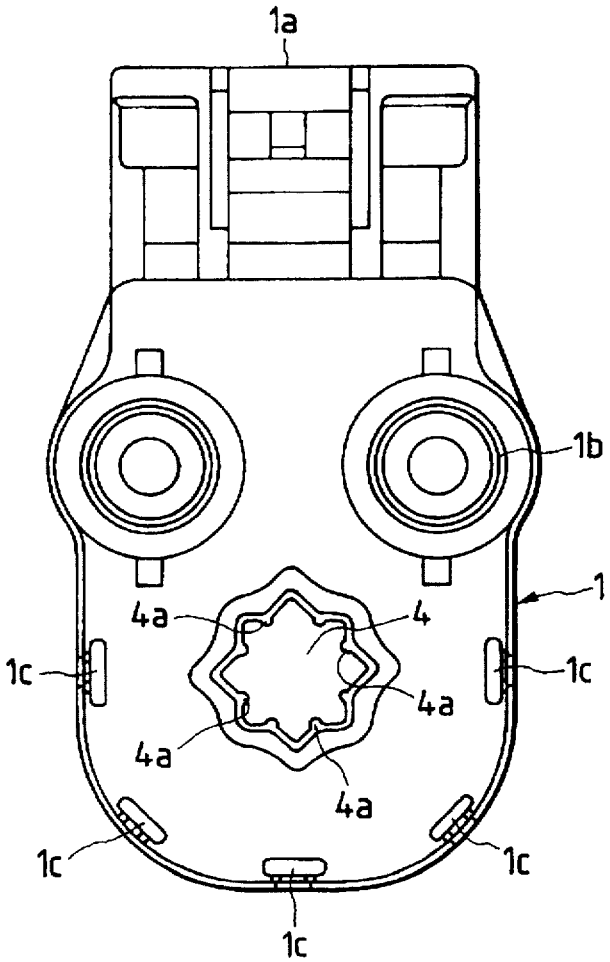
FIG. 16 is a side view similar to FIG. 3 but showing a modified core-insertion hole in accordance with the present invention.

VII) As shown in FIG. 15, flat surface portion 241*a* and connecting portion 233*a* confronting each other are clamped by a pair of welding electrodes 251. Then, a high voltage is applied between these welding electrodes 251, thereby firmly connecting these flat surface portion 241*a* and connecting portion 233*a* by projection welding. If there is a slightly large gap between these flat surface portion 241*a* and connecting portion 233*a*, second flat surface portion 233 will be adequately bent at its neck portion 233*c* when clamped by welding electrodes 251, as indicated by an alternate long and two short dashes line in FIG. 15. Thus, it becomes possible to assure a satisfactory welding strength by preventing an undesirable force from acting on the welding portion.

VIII) Two separated iron cores 3 are inserted into core-insertion hole 4 defined by primary bobbin 217*b* from its both ends, thereby furnishing the ignition coil.

IX) Finally, melted resin 243 is supplied into coil casing 1 from the same side as opening portions 213*a* and 217*a*. Subsequently, resin 243 is hardened in coil casing 1. Filling the opening side of coil casing 1 with resin 243 is to provide a waterproofing structure for protecting ignitor 211, windings 221 and 223, etc.

In this manner, according to the present embodiment, pins 231 are assembled after accomplishing the fabrication of coil casing 1. Hence, there is no need for positioning pins 231 during the molding of coil casing 1. An angled arrangement of each pin 231 with 90° along folding line 235 makes it possible to bring its connecting portion 233*a* into a confronting relation with the corresponding flat plate portion 241*a* of terminal 241 by solely inserting pin 231 into coupling hole 207*a*. Hence, the projection welding can be easily performed from the right side.

Furthermore, providing concave and convex portions 31*b* and 32*b* at the distal ends of lower limbs of first and second iron cores 31 and 32 makes it possible to firmly maintaining the engagement of first and second iron cores 31 and 32 by coupling these concave and convex portions 31*b* and 32*b* before the ignition coil is installed on an automotive vehicle. Hence, installation of the ignition coil onto the automotive vehicle can be facilitated, reducing the installation costs.

Figure 18:
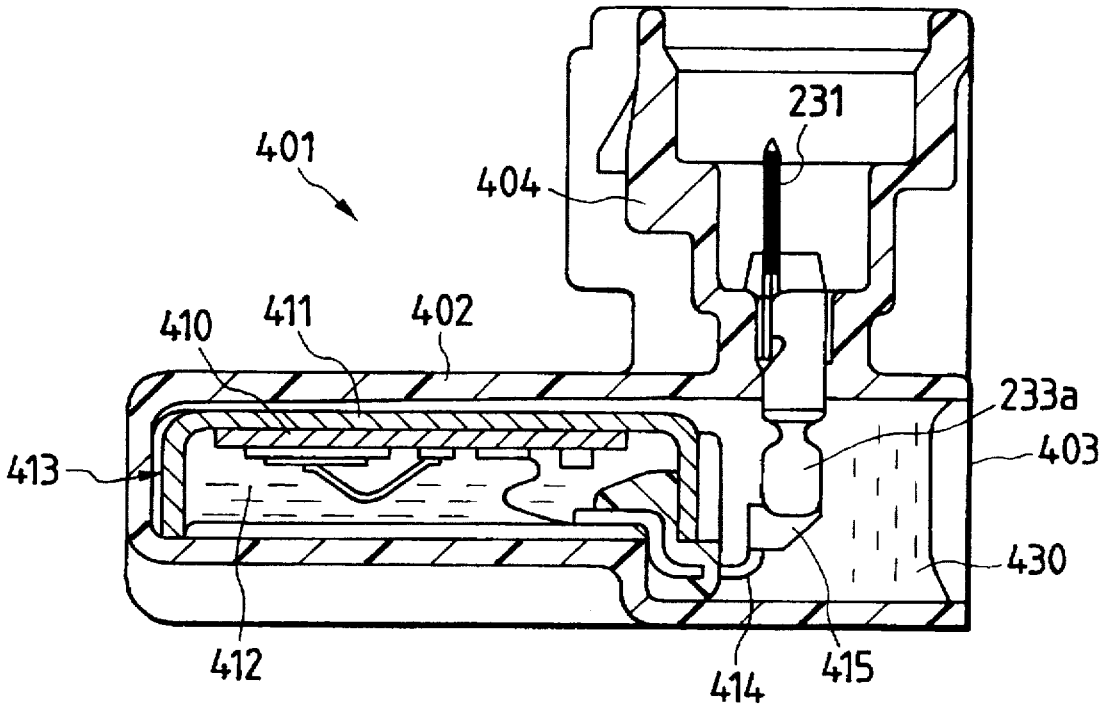
FIG. 18 is a cross-sectional view showing an arrangement of a third embodiment of the present invention.

Regarding the configuration of core-insertion hole 4 defined by primary bobbin 217*b*, its cross section can be modified into other shape such as a unique symmetrical shape shown in FIG. 18 equivalent to the silhouette of two identical squares angularly offset at 45°, which has a total of eight perpendicular corners.

Although the above-described embodiment discloses first and second iron cores 31 and 32 which are both engaged between the inside wall of core-insertion hole 4 and the outer wall of coil casing 1, it is of course possible to clamp the coil 2 by only one of these first and second iron cores 31 and 32.

The position of each protrusion 1*c* is not limited to the outer peripheral end of the bottom surface 1*f* of coil casing 1; each protrusion 1*c* can be provided on any place on the bottom surface 1*f*.

Regarding the configuration of first and second iron cores 31 and 32, it is not limited to the C shape configuration disclosed in this embodiment. For example, the present invention can be applied to E-shaped iron cores.

Second Embodiment

Figure 17:
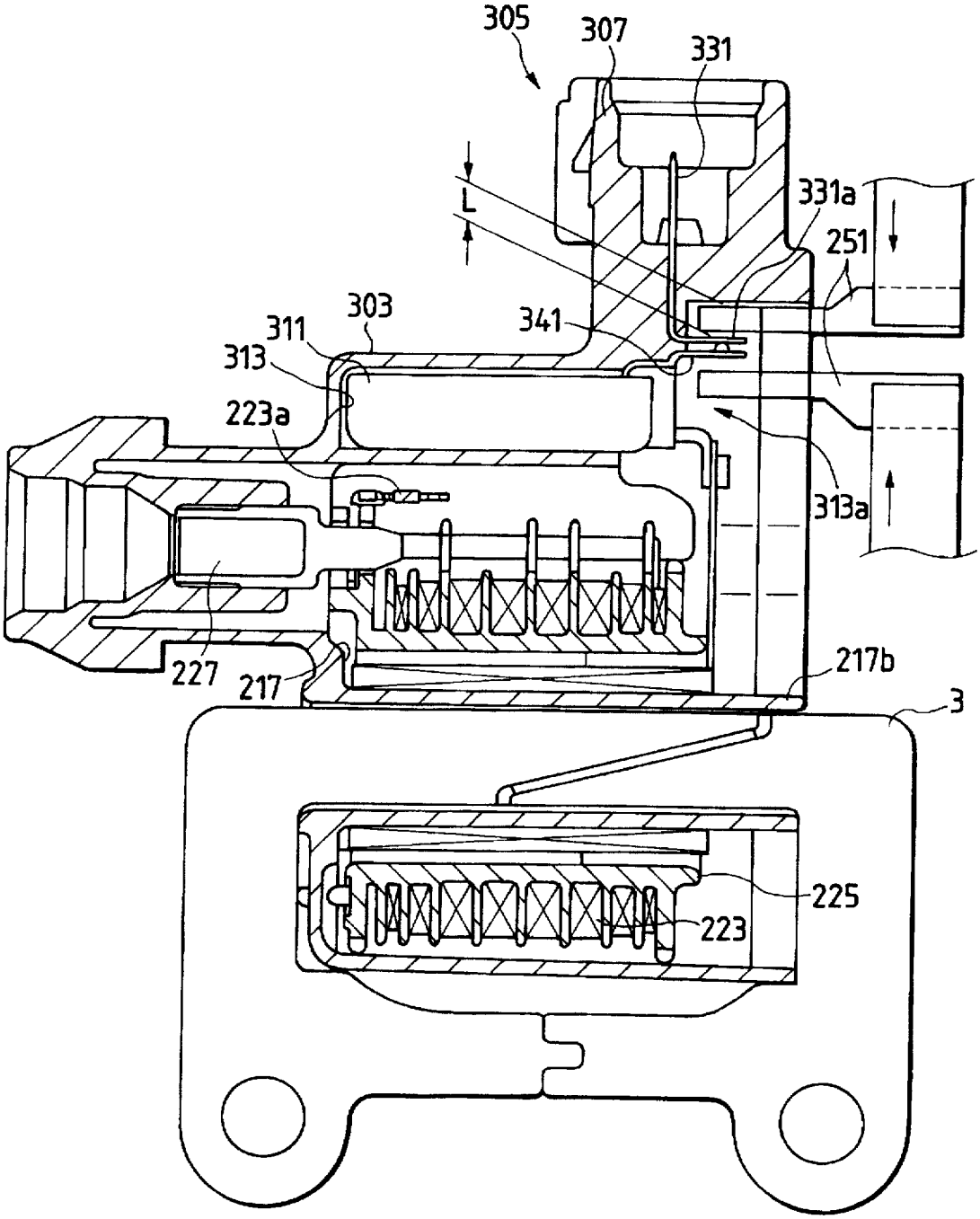
FIG. 17 is a cross-sectional view showing an arrangement of an ignition coil in accordance with a second embodiment of the present invention.

FIG. 17 is a cross-sectional front view showing an arrangement of the ignition coil in accordance with a second of the present invention. The ignition coil of the second embodiment is characterized in that it requires the positioning of connector pins before its coil casing is molded.

More specifically, as shown in FIG. 17, each pin 331 is bent perpendicularly and having a lower end 331*a* extending horizontally into an opening section 313*a*. After positioning these pins 331, a coil casing 303 and a shell 307 are integrally formed by molding. An ignitor 311, accommodated in an ignitor housing 313, has terminals 341 protruding horizontally from its end surface toward opening section 313*a* under a connector 305. When ignitor 311 is inserted and settled in ignitor housing 313, terminals 341 are brought into a closer and parallel confronting relation with their corresponding base end portions 331*a*. Each terminal 341 and corresponding base end portion 331*a* can be clamped by welding electrodes 251. And, projection welding can be performed by applying a high voltage to these welding electrodes 251, thereby electrically connecting each pin 331 with ignitor 311. Other arrangement is basically identical with that of the first embodiment, and hence will not be explained again.

As explained above, the second embodiment is different from the first embodiment in that pins 331 need to be placed in position when coil casing 303 and shell 307 and in that a clearance L is provided between the base end portion 331*a* of each pin 331 and shell 307 for an insertion space of welding electrode 251. However, the second embodiment is substantially the same with the first embodiment in that connector 305 is disposed in the vicinity of opening portion 313*a* and in that pins 331 are disposed perpendicularly to the longitudinal direction (i.e. insertion direction) of ignitor 311. Hence, it becomes possible to shorten the conductive path between pins 331 to terminals 341, as well as downsizing of coil casing 303.

Furthermore, to eliminate the positioning operation of pins 331 performed before integrally molding coil casing 303 and shell 307, it will be also possible to insert a straight pin 331 into a bottom hole of shell 307 and then bend the lower end of each pin 331.

Furthermore, although connector pins 231 and 331 disclosed in the above-described embodiments are formed into a flat plate, it is needless to say that the present invention can be applied to a polar pin or a socket contact.

Third Embodiment

A third embodiment will be explained with reference to FIG. 18. The third embodiment is an ignitor circuit unit which can be used independently and disposed separately from the ignition coil.

More specifically, as shown in FIG. 18, a resin casing 401 comprises a circuit housing 402 and a connector housing 404 integrally formed with each other. Circuit housing 402 has a cylindrical body with a bottom. Connector housing 404 extends in a direction normal to the axis of circuit housing 402. Circuit housing 402 has a rectangular opening 403 extending in a direction perpendicular to the paper face of FIG. 18.

An ignitor unit 413 is forcibly and firmly inserted into circuit housing 402. A hybrid circuit substrate 410, constituting an ignitor circuit, is placed in a stainless container 411 and sealed with resin 412 by the potting sealing method. Ignitor unit 413 has an appearance of a plate-like component having an elongated rectangular cross section. A plurality of terminals 414, each being connected to the circuit, are provided on a side surface of ignitor unit 413. These terminals 414 extend toward the opening 403. A distal end 415 of each terminal 414 is angled and disposed in parallel with the paper face of FIG. 18.

On the other hand, connector housing 404 receives connector pins 231 shown in FIGS. 11A and 11B which are forcibly and firmly inserted into bottom holes of connector housing 404. More specifically, connector housing 404 is formed with a plurality of slit holes for receiving and fixing the coupling portion 233*b* of each pins 231. Each pin 231 is forcibly and firmly inserted into the slit hole, after ignitor unit 413 is inserted into circuit housing 402. Connecting portion 233*a* of pin 231 protrudes into an opening-side pace of ignitor 413, so that ignitor unit can be prevented from being pulled out.

Subsequently, the connecting portion 233*a* of each pin 231 and the distal end 415 of corresponding terminal 414 are electrically connected by the projection welding. In this case, two arms (electrodes) of the welding machine are disposed in such a manner that they are opened or closed in the longitudinal direction of opening 403. Finally, resin 430 is supplied to seal and accomplish the ignitor circuit.

According to this embodiment, a dead space in circuit housing 402 can be effectively used. More specifically, the opening-side space of circuit housing 402 is left uselessly once the installation of ignitor unit 413 is finished. However, the present embodiment effectively utilizes this dead space for connecting terminals 414 extending from ignitor unit 413 with connector pins 231 extending perpendicularly from connector housing 404. Thus, it becomes possible to reduce the size of the casing. Especially, it is important to execute the insertion of pins 231 into connector housing 404 after finishing the installation of ignitor unit 413.

Furthermore, the angled configuration of distal end 415 of terminal 414 (i.e. the arrangement of distal end 415 parallel to the paper face of FIG. 18) is effective in view of securing a necessary space for electrical connection between distal end 415 and connecting portion 233*a*, thereby preventing the interval of pins 231 from being enlarged undesirably.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. An ignition coil for an internal combustion engine comprising:

at least one iron core for forming a magnetic path, aid iron core having first and second portions disposed in parallel with each other; and a cylindrical coil body for accommodating a primary coil and a secondary coil therein, said cylindrical coil body having a core-insertion hole for receiving said iron core;

wherein said first portion is inserted in said core-insertion hole while said second portion extends along an outer wall of said cylindrical coil body, so that said cylindrical coil body is engaged with said iron core by said first and second portions clamping between an inside wall of said core-insertion hole and said outer wall of said cylindrical coil body.

2. The ignition coil in accordance with claim 1, wherein two iron cores are provided at both axial ends of said cylindrical coil body, so that said magnetic path is formed by said two iron cores clamping said axial ends of said cylindrical coil body.

3. The ignition coil in accordance with claim 1, wherein a deformable portion is integrally formed on the outer wall of said coil body, so that said iron core is engaged with said coil body through said deformable portion.

4. The ignition coil in accordance with claim 1, wherein a slant guide surface is provided adjacently to and continuously from said second portion of said iron core so that a clearance between said iron core and said outer wall of said coil body is enlarged at a portion corresponding to said slant guide surface.

5. The ignition coil in accordance with claim 1, wherein said core-insertion hole is configured into a shape allowing an axial movement of said iron core but preventing an angular or rotational displacement of said iron core with respect to said core-insertion hole.

6. The ignition coil in accordance with claim 5, wherein said iron core has a rectangular cross section and said core-insertion hole has a polygonal cross section.

7. The ignition coil in accordance with claim 1, wherein said primary coil comprises an outermost layer and a plurality of inner layers, each of said inner layers is formed into a dense alignment winding layer formed by winding a self-bonding type wire rod in such a manner that adjacent wire rods are brought into contact with each other in each layer, while said outermost layer is formed by winding said wire rod into the dense alignment winding layer only at both ends thereof and into a non-dense alignment winding layer in a middle portion thereof so that adjacent wire rods of said outermost layer can be spaced from each other at the middle portion.

8. The ignition coil in accordance with claim 7, wherein said both ends of said outermost layer are formed into the dense alignment winding layer by winding said wire rod by two terns or more.

9. The ignition coil in accordance with claim 1, wherein said coil body comprises a circuit housing for accommodating an ignitor circuit and said primary and secondary coils therein, and a connector formed in the vicinity of an opening portion of said circuit housing, said connector has connector terminals extending perpendicularly to an insertion direction of said ignitor circuit along which said ignition circuit is inserted into said circuit housing.

10. The ignition coil in accordance with claim 9, wherein said ignitor circuit comprises circuit terminals extending into said opening portion of said circuit housing, while said connector terminals extend into said opening portion of said circuit housing and are connected to said circuit terminals.

11. The ignition coil in accordance with claim 10, wherein said circuit terminals are disposed in a row on an end surface of said ignitor circuit closer to said opening portion of said circuit housing, each circuit terminal has a flat surface portion parallel to said insertion direction of said ignitor circuit and an axial direction of each connector terminal, said connector terminal has a first flat surface portion and a second flat surface portion, said first flat surface portion is parallel to an aligning direction of said circuit terminals and said axial direction of said connector terminal, and said second flat surface portion is disposed in parallel with and connected to said flat surface portion of said circuit terminal.

12. The ignition coil in accordance with claim 7, wherein said coil body comprises a circuit housing accommodating an ignitor circuit and said primary and secondary coils therein, and a connector formed in the vicinity of an opening portion of said circuit housing, said connector has connector terminals extending perpendicularly to an insertion direction of said ignitor circuit along which said ignition circuit is inserted into said circuit housing.

13. The ignition coil in accordance with claim 12, wherein said ignitor circuit comprises circuit terminals extending into said opening portion of said circuit housing, while said connector terminals extend into said opening portion of said circuit housing and are connected to said circuit terminals.

14. The ignition coil in accordance with claim 13, wherein said circuit terminals are disposed in a row on an end surface of said ignitor circuit closer to said opening portion of said circuit housing, each circuit terminal has a flat surface portion parallel to said insertion direction of said ignitor circuit and an axial direction of each connector terminal, said connector terminal has a first flat surface portion and a second flat surface portion, said first flat surface portion is parallel to an aligning direction of said circuit terminals and said axial direction of said connector terminal, and said second flat surface portion is disposed in parallel with and connected to said flat surface portion of said circuit terminal.

15. An ignition coil for an internal combustion engine comprising:

a primary coil; and a secondary coil provided around said primary coil, wherein said primary coil comprises an outermost layer and a plurality of inner layers, each of said inner layers is a dense alignment winding layer formed by winding a self-bonding type wire rod in such a manner that adjacent wire rods are brought into contact with each other in each layer, while said outermost layer is formed by winding said wire rod into the dense alignment winding layer only at both ends thereof and into a non-dense alignment winding layer in a middle portion thereof so that adjacent wire rods of said outermost layer can be spaced from each other at the middle portion.

16. The ignition coil in accordance with claim 15, wherein said both ends of said outermost layer are formed into the dense alignment winding layer by winding said wire rod by two terns or more.

17. An ignition coil for an internal combustion engine comprising:

an ignition coil;

an ignitor circuit comprising a semiconductor element for controlling intermittent supply of a primary current to said ignition coil;

a circuit housing for accommodating said ignitor circuit therein; and a connector disposed in the vicinity of an opening portion of said circuit housing, and having connector terminals electrically connected to said ignitor circuit, wherein said connector terminals extend perpendicularly to an insertion direction of said ignitor circuit along which said ignition circuit is inserted into said circuit housing.

18. The ignition coil in accordance with claim 17, wherein said ignitor circuit comprises circuit terminals extending into said opening portion of said circuit housing, while said connector terminals extend into said opening portion of said circuit housing and are connected to said circuit terminals.

19. The ignition coil in accordance with claim 18, wherein said circuit terminals are disposed in a row on an end surface of said ignitor circuit closer to said opening portion of said circuit housing, each circuit terminal has a flat surface portion parallel to said insertion direction of said ignitor circuit and an axial direction of each connector terminal, said connector terminal has a first flat surface portion and a second flat surface portion, said first flat surface portion is parallel to an aligning direction of said circuit terminals and said axial direction of said connector terminal, and said second flat surface portion is disposed in parallel with and connected to said flat surface portion of said circuit terminal.

* * * * *